United States Patent [19]

Montgomery

[11] 4,120,390

[45] Oct. 17, 1978

[54] CROSSOVER DUMP AND CONVEYOR ADVANCER

[76] Inventor: Warren G. Montgomery, 2 Berwood Dr., Rte. 8, Morgantown, W. Va. 26505

[21] Appl. No.: 756,489

[22] Filed: Jan. 3, 1977

[51] Int. Cl.[2] ..... B65G 41/00

[52] U.S. Cl. ..... 198/309; 198/301; 198/594; 198/735; 198/862; 299/45

[58] Field of Search ..... 198/301, 303, 309, 311, 198/312, 315, 316, 539, 560, 585, 594, 606, 735, 862, 364; 299/45, 56, 64, 67

[56] References Cited

U.S. PATENT DOCUMENTS

| | | | |
|---|---|---|---|
| 2,219,515 | 10/1940 | Doberstein | 198/309 |
| 2,736,420 | 2/1956 | McCarthy | 198/585 |
| 2,781,890 | 2/1957 | Mercier | 198/301 |
| 3,003,612 | 10/1961 | Poundstone | 198/303 |
| 3,107,776 | 10/1963 | Long | 198/303 |
| 3,114,425 | 12/1963 | Adams | 299/56 |
| 3,279,584 | 10/1966 | Towles | 198/303 |
| 3,297,140 | 1/1967 | Cannon et al. | 198/862 |
| 3,497,055 | 2/1970 | Oslakovic et al. | 198/303 |
| 3,604,754 | 9/1971 | Kampf-Emden | 299/56 |
| 3,664,486 | 5/1972 | Mares | 198/862 |

FOREIGN PATENT DOCUMENTS

| | | | |
|---|---|---|---|
| 2,231,848 | 1/1974 | Fed. Rep. of Germany | 198/862 |
| 1,007,532 | 10/1965 | United Kingdom | 198/735 |
| 1,098,972 | 1/1968 | United Kingdom | 198/862 |
| 1,168,012 | 10/1969 | United Kingdom | 198/735 |

*Primary Examiner*—Evon C. Blunk
*Assistant Examiner*—Richard K. Thomson
*Attorney, Agent, or Firm*—Pennie & Edmonds

[57] ABSTRACT

A crossover dump and conveyor advancer for a main conveyor means supported by a movable pan line. The crossover dump includes a tunnel portion through which the pan line extends and entry and reentry ramps supporting portions of the main conveyor are provided for carrying the main conveyor over a secondary conveyor which extends cross-wise to and above the pan line. Material carried by the main conveyor is moved up the entry ramp where it then falls onto the secondary conveyor. A conveyor advancer is included to move the pan line relative to the crossover dump in order that the conveyor system may be advanced or retracted. The main conveyor is adapted to connect with a continuous mining machine by way of a bridge conveyor. The pan line supporting the main conveyor has limit switches near the tailpiece which when contacted by the bridge conveyor will cause the conveyor advancer to advance or retract the pan line. The conveyor advancer engages with the pan line by means of forward and retract pawl mechanisms in order that the advancer may advance or retract the pan line.

8 Claims, 8 Drawing Figures

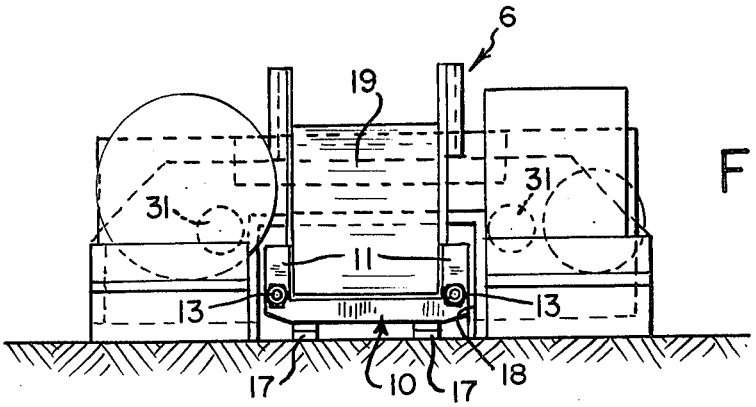
FIG. 4
FIG. 5
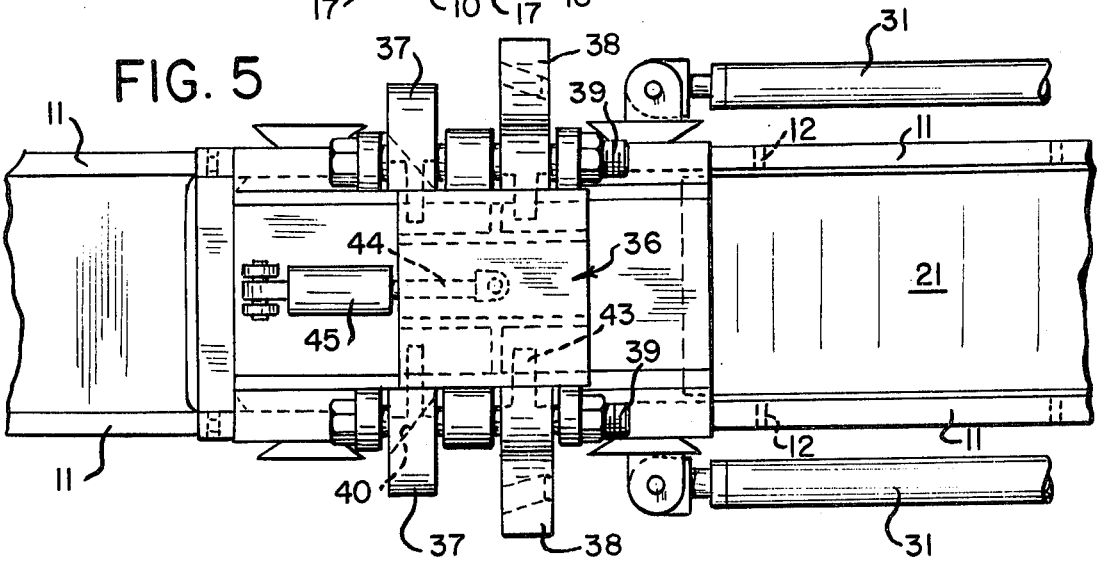
FIG. 6
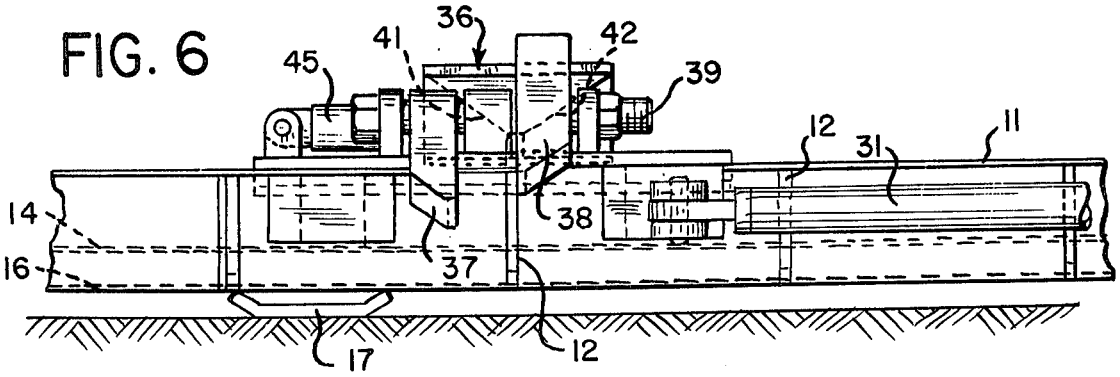
FIG. 8
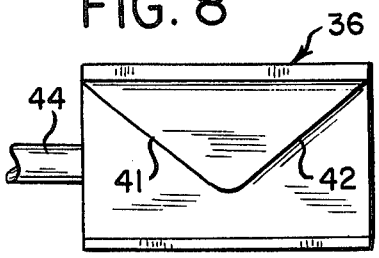
FIG. 7
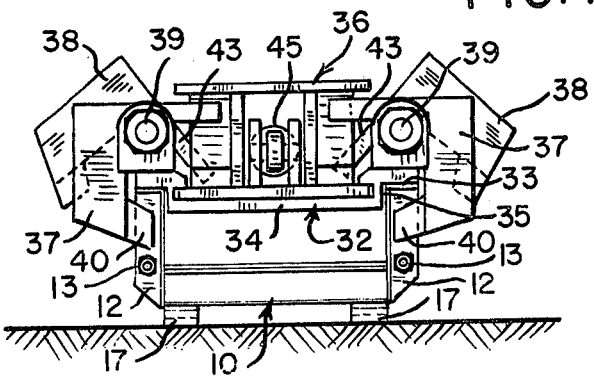

CROSSOVER DUMP AND CONVEYOR ADVANCER

FIELD OF THE INVENTION

The invention relates to a conveyor system adaptable for use with a continuous mining machine and where the conveyor system may be readily and easily advanced or retracted without disassembly or shutdown of the system in order to accommodate movement of the mining machine. The conveyor system is adaptable for use in restricted areas and makes use of conventional chain-type conveyors supported by conventional pan lines comprising a plurality of pan sections. The system is particularly adaptable for use with secondary cross-conveyors which extend transversely to a main conveyor and where the secondary conveyor is to convey material received by it from the main conveyor to further means for removal from a mine.

DESCRIPTION OF THE PRIOR ART

Pan-type flight chain conveyors have been used in the past to move coal or other material from the working face of a mine to mine cars located some distance from the face. Such conveyorsare particularly useful when working low seams of coal having restricted heights. The conveyors incorporate a pan line made up of a number of pan sections which are bolted together along connecting flanges and which support a chain conveyor and connected flights on the pan deck when conveying material and which includes a return deck positioned beneath the pan floor for supporting the chain conveyor when it is returning to the material loading area. The pan sections are usually made of six foot lengths in order to make them light enough such that a man might physically move them in restricted quarters. In order to advance or retract such a conveying system, it is necessary to shut down the conveyor system, break the chain conveyor, install or remove a new pan section and then insert a new length of chain, all of which is time consuming.

With the advent of mechanical loading machines to replace hand loading of conveyor systems, a new unit was added to connect the loading machine to the conveyor system. This unit incorporates a bridge conveyor which is connected by a swivel to a load boom carried by the loader and where one end of the bridge conveyor rides on a dolly slidable on the pan line. This arrangement permits free movement of the loading machine laterally of the pan line to gather prepared coal.

The introduction of continuous mining machines to a degree eliminated use of loading machines since the continuous mining machine is connected to the conveyor by a bridge conveyor of the same type as used with the loading machine. The continuous mining machine is thus permitted to extract a depth of coal equal to the length of the bridge conveyor before the main conveyor system has to be broken down in order to add additional pan and chains. In some instances, as when making a break through in a direction perpendicular to the conveyor pan line, it is necessary to move the mining machine back along the conveyor pan line to a point where it is necessary to shorten the pan line. In such cases, as also when lengthening the pan line, it becomes necessary to shut down the conveyor system and to remove pan sections and chain lengths.

Conveyor systems have been proposed which utilize a main conveyor over which an extendable secondary conveyor is suspended and which connects with a continuous mining machine in an attempt to reduce the down time occasioned by changing the conveyor length. For example, see the system disclosed in U.S. Pat. No. 3,204,755. However, because such systems usually call for the secondary conveyor to be located above or to one side of the main conveyor, they are not applicable for use in thin or narrow seams. Further, such systems are still limited in advancement or retraction of the conveyor system by the length of the secondary conveyor.

It is an object of my invention to provide for a conveyor system in which the complete pan line may be advanced or retracted to accommodate change in position of a continuous mining machine without the necessity of shutting the conveyor system down in order to install or remove pan sections or chain lengths.

It is a further object of the invention to provide for a conveyor advance means which may be automatically actuated by movement of a continuous mining machine beyond a pre-set limit such that the conveyor system may be automatically advanced or retracted to accommodate repositioning of the mining machine.

It is a further object of my invention to provide for a main conveyor means which may be moved relative to a secondary cross-conveyor means without shutdown of either conveyor means.

SUMMARY OF THE INVENTION

Broadly a conveyor system according to my invention comprises a main conveyor means which is carried by a pan line made up of individual pan sections. Preferably a crossover dump including a tunnel portion is provided where the pan line extends through the tunnel portion and where the dump in addition has entry and reentry ramps extending from the pan line to a position above and to either side of a secondary conveyor means which extends in a transverse direction with respect to the main conveyor means and which is positioned over the pan line. Material conveyed by the main conveyor will then be moved up the entry ramp where it will fall onto the secondary conveyor means.

Preferably the crossover dump includes anchor means by which it may be anchored with respect to the supporting ground and also includes advance means by which the pan line may be moved through the tunnel portion of the dump when the dump is anchored with respect to the supporting ground. The advance means include at least one jack which is connected at one end to the crossover dump and at its other end to a yoke which is slidable on the top of the pan line. The yoke is provided with advance and retract pawls adapted to engage flanges by which individual sections of the pan line are connected together. The pawls are selectively moved out of driving engagement with the flanges by means of a wedge element which is slidably mounted on the yoke. The pawls are pivoted off center so that they drop into driving engagement with the flanges under the force of gravity when they are not moved away by the wedge element. A wedge moving means in the form of a hydraulic cylinder is mounted on the yoke to provide selective movement to the wedge element and selective operation of the pawls.

Preferably the conveyor system includes at its loading end a bridge conveyor which at one end is adapted to connect with a continuous mining machine and at its other end to ride on a dolly which is slidable on the pan line. Limit switches are provided on the pan line which when engaged by the dolly or end of the bridge conveyor will actuate the wedge moving means to cause the wedge element to move in a desired direction and to cause actuation of the jack means by which the pan line may be automatically extended or retracted so as to accommodate repositioning of the continuous mining machine.

The conveyor system also preferably includes controls by which the jack means and wedge moving means may be actuated when the crossover dump is unanchored with respect to the supporting ground in order that the dump may be moved relative to the pan line and supporting ground.

DESCRIPTION OF THE DRAWINGS

FIG. 4 is an end view of a crossover dump of FIG. 2;

FIG. 5 is an enlarged plan view of a portion of FIG. 2 illustrating advance means for providing advance and retraction movements to the conveyor system;

FIG. 6 is a side view of the structure of FIG. 5;

FIG. 7 is an end view of the structure of FIG. 6; and

FIG. 8 is an enlarged side view of a wedge element for moving retract and advance pawls of the advance means.

DETAILED DESCRIPTION OF THE PREFERRED EMBODIMENTS

Figure 1:
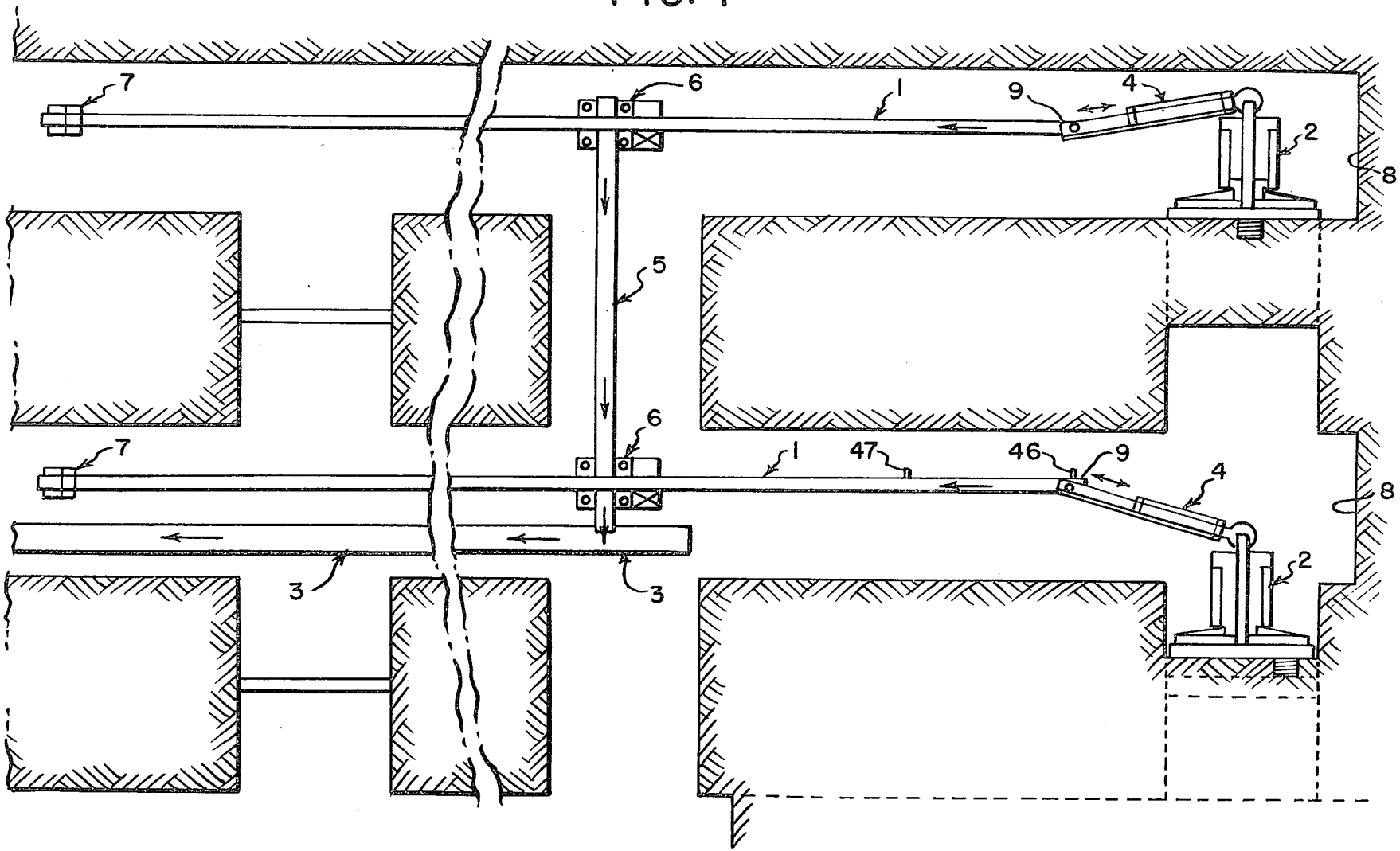
FIG. 1 is a schematic plan view of conveyor systems according to the invention connected to continuous mining machines.

Referring to FIG. 1 there is illustrated schematically a conveyor system according to the invention incorporating two main conveyor means 1 utilized to convey material mined by continuous mining machines 2 to a butt conveyor means 3 for removal from the mine or to further areas. Each of the continuous mining machines 2 is connected to a main conveyor means 1 by way of a telescoping bridge conveyor 4 having one end connected to the machine and its other end to a dolly, not shown, which rides on the top of the pan line. Both of the main conveyor means 1 are joined by a cross or secondary conveyor means 5 which conveys material from the main conveyor means to the butt conveyor means 3. The secondary conveyor means 5 is supported by crossover dumps 6 which also include drive means for driving the conveyor 5. Each main conveyor means 1 has conventional drive means 7 at one end thereof.

As each continuous mining machine 2 cuts further into the working face 8, its bridge conveyor 4 will approach the tailpiece 9 of the main conveyor means which in conventional conveyor systems would require that the main conveyor means be shut down, the chain conveyor broken, additional pan sections added and additional chain lengths added in order to increase the length. By my invention as described in greater detail hereafter, I provide a conveyor advance means by which the complete main conveyor means may be advanced without the necessity of breaking the conveyor means and adding additional pan sections.

In some instances it may be necessary to back up the continuous mining machine 2 to position it for a break through such as shown in FIG. 1. In this event means are provided for retracting the complete main conveyor so that the conveyor system does not have to be broken down in order to shorten it.

Figure 2:
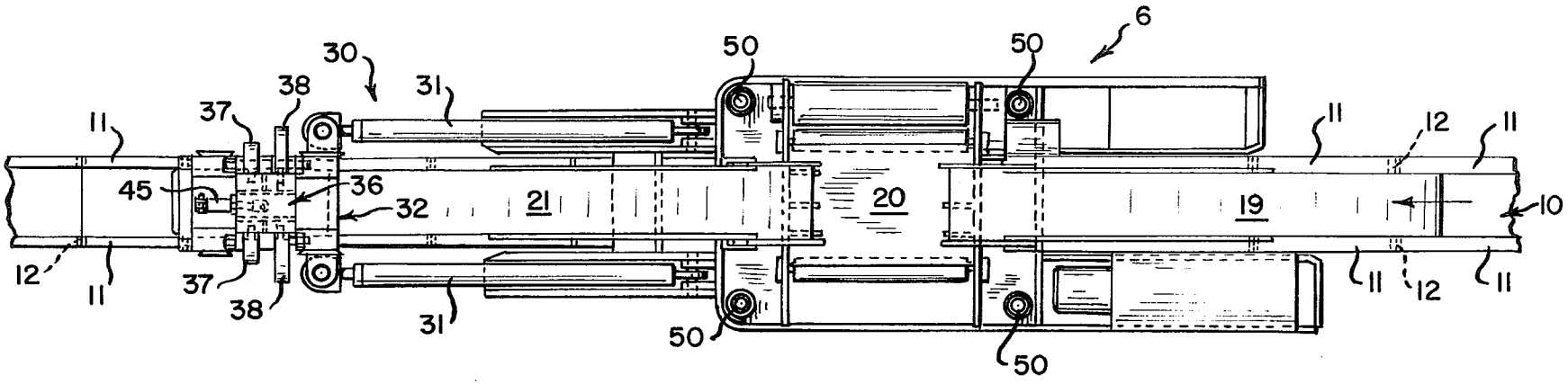
FIG. 2 is an enlarged plan view of a crossover dump portion of a conveyor system illustrated in FIG. 1.
Figure 3:
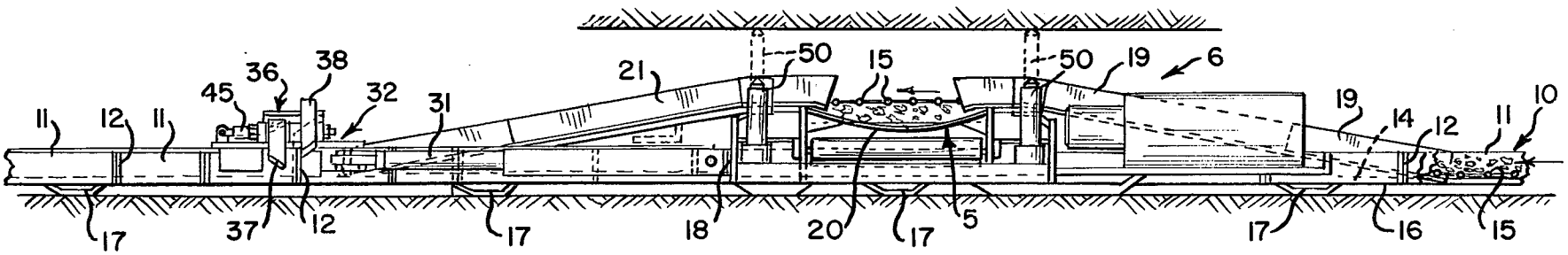
FIG. 3 is a side view of a crossover dump of FIG. 2.

Referring to FIGS. 2 and 3, the crossover dump 6 by which the main conveyor system transfers material to the secondary conveyor system 5 and by which the advance and retraction movements are applied to the main conveyor system is illustrated. The main conveyor means comprises a pan line 10 made up of a plurality of individual pan sections 11 connected together at flanges 12 by conventional means, i.e. bolts 13 as shown in FIG. 7. The individual pan sections are of a size so that they may be conveniently handled by one man in restricted areas. The pan section has a deck 14 providing support to a conveyor chain 15 by which material is moved. A bottom deck 16 of a pan provides a further support to the chain conveyor on its return movement to the tailpiece 9 of the pan line. Skids 17 are provided for supporting some of the pan sections relative to the ground and on which the pan line may be moved.

The crossover dump includes a tunnel portion 18 as shown in FIG. 3 through which the pan line 10 extends. An entry ramp 19 carries a portion of the chain conveyor 15 from the pan line upward and over the secondary conveyor means 5 which comprises a belt 20 while a reentry ramp 21 which extends from a position over the secondary conveyor means returns the chain conveyor back to the pan line. As material is moved up the ramp 19, it will pass over the secondary conveyor belt 20 and since no supporting floor is provided for the chain 15 between the ramps 19 and 21, the material will fall through the chain sections onto the secondary conveyor belt.

The crossover dump 6 is provided with an advance means 30 which comprises two hydraulic jacks 31 which are connected to a yoke 32 which as shown in FIG. 7 is slidable along upturned flange portions 33 of each individual pan section 11. The yoke 32 includes a recessed portion 34, the sides 35 of which provide a guide for the yoke with respect to the side wall of the pan section. The recessed portion 34 also provides a track in which a wedge element 36 may slide, as explained more fully hereafter.

Advance or forward pawls 37 and retract or reverse pawls 38 are mounted on the yoke 32 by means of pivots 39 which are off center with respect to the center of gravity of the pawls such that the pawls tend to rotate to the downward position as shown by pawls 37 in FIG. 6. The pawls are adapted to engage the connecting flanges 12 adjoining the adjacent pan sections as shown in FIG. 6 so as to provide a driving force for movement of the pan line. Both the retract and advance pawls have tapered surfaces 40 at their ends in order that the pawls may slide over the surface of the flange when the yoke is moved longitudinally on a return stroke of the hydraulic jacks.

The pawls 37 and 38 are lifted against the force of gravity out of driving engagement with the flanges 12 by means of wedge surfaces 41 and 42 carried on the slidable wedge block 36. The wedge surfaces 41 and 42 engage with inclined surfaces on legs 43 on the pawls. Thus referring to FIG. 6 movement of the wedge element 36 to the left as shown in the figure will cause the wedge surface 41 to engage a sloping surface on the leg of pawl 37 to cause the pawl to move in an upward direction about its pivot 39. Simultaneously the pawl 38 will fall under the force of its weight to a lower position.

The wedge block 36 is connected by rod 44 to a hydraulic cylinder 45 which provides the force necessary to move the wedge block.

The tailpiece portion of the main conveyor means adjacent the loading end is preferably provided with an advance limit switch 46 and a retract limit switch 47 adapted to be contacted by a dolly which supports the end of the bridge conveyor. The limit switches are connected by conventional circuitry to means operating the hydraulic power means driving the movable wedge element to move the element to either retract or advance position whereby either the retract or advance pawls will engage a flange 12. The same circuitry will then actuate the jacks 31 to cause the yoke to move either in the retract or advance directions which will then move the pan line including the conveyor system in the desired direction when the crossover dump is anchored to the supporting ground. At the end of a full stroke of the hydraulic means comprising the jack 31, the jack will retract with the pawls in the downward flange engaging position sliding over the flanges until the pawls are again in position with respect to the flanges for a further advance or retraction stroke of the jack means. Because the complete conveyor system including the drive system for the chain conveyor is slidable with respect to the ground and with respect to the crossover dump, the system may be kept operating while being advanced or retracted thus eliminating unnecessary down time of the continuous mining machine and subsequent loss of production.

The crossover dump is provided with stabilizing jacks 50 by which the crossover dump may be firmly anchored with respect to the supporting ground. When it becomes necessary to advance the crossover dump to a new position such as would occur when an entirely different area is to be mined, the stabilizing jacks are retracted so as to unanchor the crossover dump with respect to the supporting ground. The jack means 31 are then operated in the same manner as when the pan line is to be advanced or retracted. The resulting driving forces will thenmove the crossover dump along the pan line since the weight of the pan line is sufficient to anchor it with respect to the ground.

I claim:

1. A conveyor system having a main conveyor means, a pan line supporting said main conveyor means, and a secondary conveyor means extending cross-wise to and above said main conveyor means and adapted to receive material carried by said main conveyor means, the improvement comprising having a crossover dump including a tunnel portion extending over a portion of said pan line and supporting a part of said secondary conveyor means where said pan line is movable through said tunnel with respect to said crossover dump and said secondary conveyor, an entry ramp extending from said pan line to a position above and to one side of said secondary conveyor means, a reentry ramp extending from a position above and to one side of said secondary conveyor to said pan line where said entry and reentry ramps support portions of said main conveyor means whereby material conveyed by said main conveyor means is conveyed up said entry ramp to fall onto said secondary conveyor means, and advance means associated with said crossover dump for engaging and moving said pan line in a series of successive incremental movements along its length with respect to said crossover dump.

2. A conveyor system according to claim 1 wherein said crossover dump includes in addition movable anchor means which in one position anchors said crossover dump with respect to the supporting ground whereby said pan line may be advanced by said advance means with respect to said crossover dump and the supporting ground and which in another position frees said crossover dump with respect to the supporting ground whereby the crossover dump may be advanced by said advance means in a series of successive incremental movements with respect to the pan line and the supporting ground.

3. A conveyor system according to claim 1 having in addition a bridge conveyor slidably connected at one end with said pan line and adapted at its other end to connect with a continuous mining machine, and limit switch means mounted on the end of said pan line adapted to be contacted by said bridge conveyor and which when contacted by said bridge conveyor will actuate said advance means to advance said pan line.

4. A pan line advance means for moving a pan line with respect to an anchor structure where the pan line comprises a plurality of U-shaped pan sections joined together at their ends along attachment flanges extending exteriorly along two vertical sides of the sections, the pan line advance comprising jack means connected at one end to said anchor structure, a movable U-shaped yoke slideable on said pan line and connected at the other end of said jack means, and gravity actuated pawls connected to said yoke for engaging the flanges extending along the two vertical sides whereby operation of said jack means causes movement of said yoke, pawls, flanges and associated pan sections.

5. A pan line advance means according to claim 4 wherein said pawls comprises an advance pawl rotatable about a pivot to engage one side of a flange and a retrack pawl rotatable about a pivot to engage an opposite side of said flange and having in addition pawl moving means for moving said pawls.

6. A pan line advance means for moving a pan line with respect to an anchor structure where the pan line comprises a plurality of pan sections joined together at their ends along attachment flanges extending exteriorly of the sections, pan line advance means comprising jack means connected at one end to said anchor structure; a movable U-shaped yoke slidable on said pan line and connected to the other end of said jack means; advance and retract pawls connected to said yoke and rotatable about a pivot where said advance pawls engage one side of a flange and said retract pawls engage an opposite side of a flange whereby operation of said jack means causes movement of said yoke, pawls, flanges and associated pan sections; and pawl moving means comprising a longitudinal movable wedge element having inclined services thereon engaging sloping surfaces on said pawls whereby when said wedge element is moved in one longitudinal direction some of said pawls will be rotated about their pivot to move out of engagement with the side of a flange and when said wedge element is moved in a second longitudinal direction opposite to said one longitudinal direction the remainder of said pawls will be moved out of engagement with the side of a flange.

7. A pan line advance means according to claim 6 where the pivot of said pawls is located off their center of gravity whereby said pawls rotate under the force of gravity to engage the side of a flange.

8. A pan line advance means according to claim 6 wherein said wedge element is slidably mounted on said yoke and having in addition wedge moving means on said yoke for moving said wedge element.

* * * * *